US009962004B2

(12) United States Patent
Bryant et al.

(10) Patent No.: US 9,962,004 B2
(45) Date of Patent: May 8, 2018

(54) PROFILE OTTOMAN LINKAGE

(71) Applicant: L&P PROPERTY MANAGEMENT COMPANY, South Gate, CA (US)

(72) Inventors: Jason Allan Bryant, Fulton, MO (US); Gregory Mark Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 235 days.

(21) Appl. No.: 14/865,142

(22) Filed: Sep. 25, 2015

(65) Prior Publication Data

US 2016/0106220 A1 Apr. 21, 2016

Related U.S. Application Data

(60) Provisional application No. 62/064,538, filed on Oct. 16, 2014.

(51) Int. Cl.

| | |
|---|---|
| ***A47C 16/02*** | (2006.01) |
| ***A47C 1/0355*** | (2013.01) |
| ***A47C 3/027*** | (2006.01) |
| ***A47C 1/022*** | (2006.01) |

(52) U.S. Cl.

CPC ..... *A47C 16/025* (2013.01); *A47C 1/022* (2013.01); *A47C 1/0355* (2013.01); *A47C 3/027* (2013.01)

(58) Field of Classification Search

CPC ..... A47C 1/0355; A47C 1/022; A47C 16/025; A47C 3/027

USPC ..... 297/85 R, 423.28

See application file for complete search history.

(56) References Cited

U.S. PATENT DOCUMENTS

| | | | | |
|---|---|---|---|---|
| 3,869,169 | A * | 3/1975 | Johnson | A47C 7/506 297/423.2 |
| 5,354,116 | A | 10/1994 | May et al. | |
| 5,374,101 | A | 12/1994 | Wiecek | |
| 7,497,512 | B2 * | 3/2009 | White | A47C 1/0355 297/85 R |
| 8,752,890 | B2 | 6/2014 | Murphy et al. | |
| 2012/0235449 | A1 | 9/2012 | Wiecek | |
| 2012/0248831 | A1 | 10/2012 | Garland | |

OTHER PUBLICATIONS

International Preliminary Report on Patentability dated Apr. 27, 2017 in International Patent Application No. PCT/US15/55677, 8 pages.

International Search Report with Written Opinion dated Dec. 31, 2015 in PCT Application No. PCT/US15/55677, 12 pages.

* cited by examiner

*Primary Examiner* — Milton Nelson, Jr.

(74) *Attorney, Agent, or Firm* — Shook, Hardy & Bacon L.L.P.

(57) ABSTRACT

An ottoman linkage is provided that moves a footrest from a closed position to an extended position. The ottoman linkage includes a front ottoman link coupled to a seat mounting plate, and an outside ottoman link pivotally coupled to the front ottoman link. A rear ottoman link is coupled to the seat mounting plate and the outside ottoman link. An inside ottoman link is pivotally coupled on a first end to the front ottoman link, and pivotally coupled on a second end to a footrest bracket, the inside ottoman link being generally in-line with the outside ottoman link when the mechanism is in an extended position, and the outside ottoman link having a width that obscures the inside ottoman link from view.

9 Claims, 19 Drawing Sheets

PROFILE OTTOMAN LINKAGE

CROSS-REFERENCE TO RELATED APPLICATIONS

This application is a nonprovisional of and claims priority to U.S. Provisional Patent Application No. 62/064,538, filed Oct. 16, 2014, entitled "Profile Ottoman Linkage,", the entire contents of which are hereby incorporated by reference.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a movable seat portion, such furniture pieces being referred to herein generally as "seating units." More particularly, the disclosure relates to an improved profile ottoman for use on chairs that present a sleek profile and fewer exposed pinch points when extended. The profile ottoman disclosed can be adapted and used on any number of seating units.

Reclining seating units exist that allow a user to forwardly extend a footrest and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, the seating unit includes one or more ottomans attached with a mechanical arrangement; in the closed position, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position, the backrest is pivoted rearward from the extended position into an obtuse relationship with the seat for lounging or sleeping.

Several modern seating units in the industry are adapted to provide the adjustment capability described above. However, the linkages extending the ottomans in these seating units present a "scissor-like" look when extended, and present undesirable pinch points. As such, a more refined, lower profile ottoman linkage would fill a void in the current field of motion-upholstery technology.

Accordingly, embodiments of the mechanism pertain to a novel, simplified ottoman linkage that presents a low profile. Further, the ottoman linkage of the invention is constructed in a simple and refined arrangement in order to provide suitable function while overcoming the above-described, undesirable features inherent within the conventional ottoman linkage mechanisms.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION OF THE INVENTION

Figure 1:
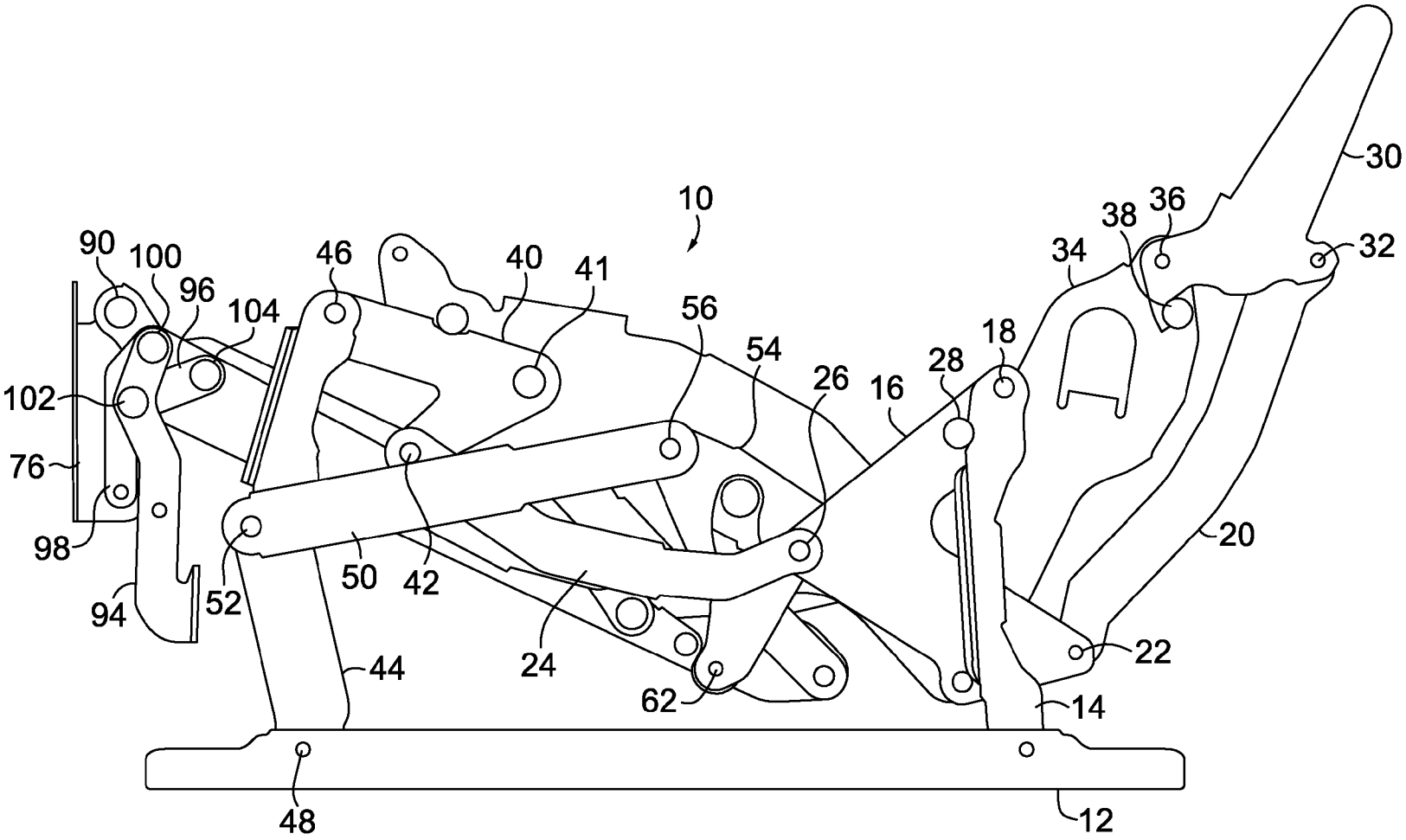
FIG. 1 is a side view of the linkage mechanism in the closed position from a vantage point internal to the seating unit, in accordance with an embodiment of the present invention.

With initial reference to the embodiment shown in FIGS. 1-9, the profile ottoman is shown incorporated into a "zero-wall" type mechanism 10. Generally, the linkage mechanism 10 guides the rotational movement of the backrest, the seat, and the ottoman(s). In an exemplary configuration, these movements are controlled by a pair of essentially mirror-image linkage mechanisms (one of which is shown herein and indicated by reference numeral 10), which comprise an arrangement of pivotably interconnected linkages. The linkage mechanisms are disposed in opposing-facing relation about a longitudinally extending plane that bisects the chair between a pair of opposed arms. As such, the ensuing discussion will focus on only one of the linkage mechanisms 10, with the content being equally applied to the other complimentary linkage assembly.

Figure 4:
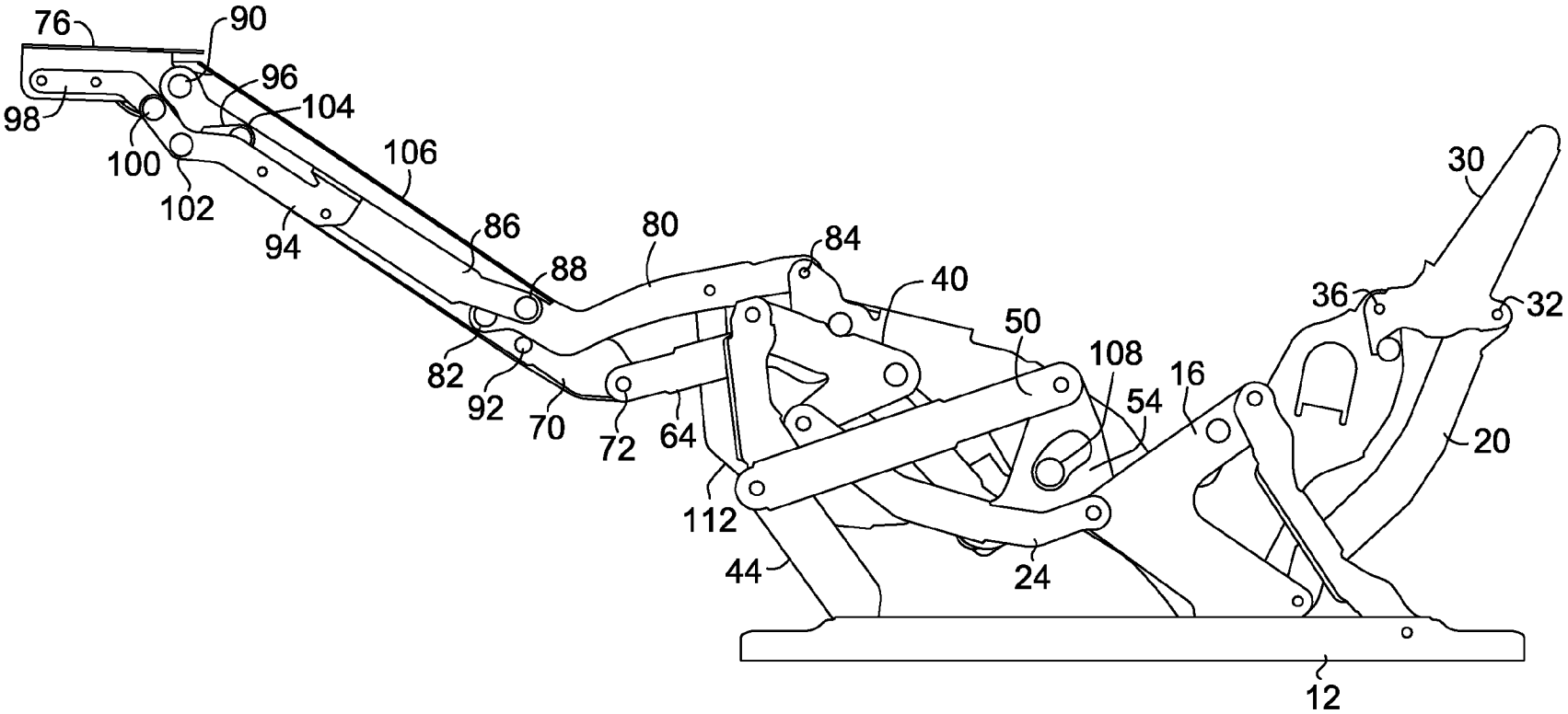
FIG. 4 is a side view of the linkage mechanism in the extended TV position from a vantage point internal to the seating unit, in accordance with an embodiment of the present invention.
Figure 7:
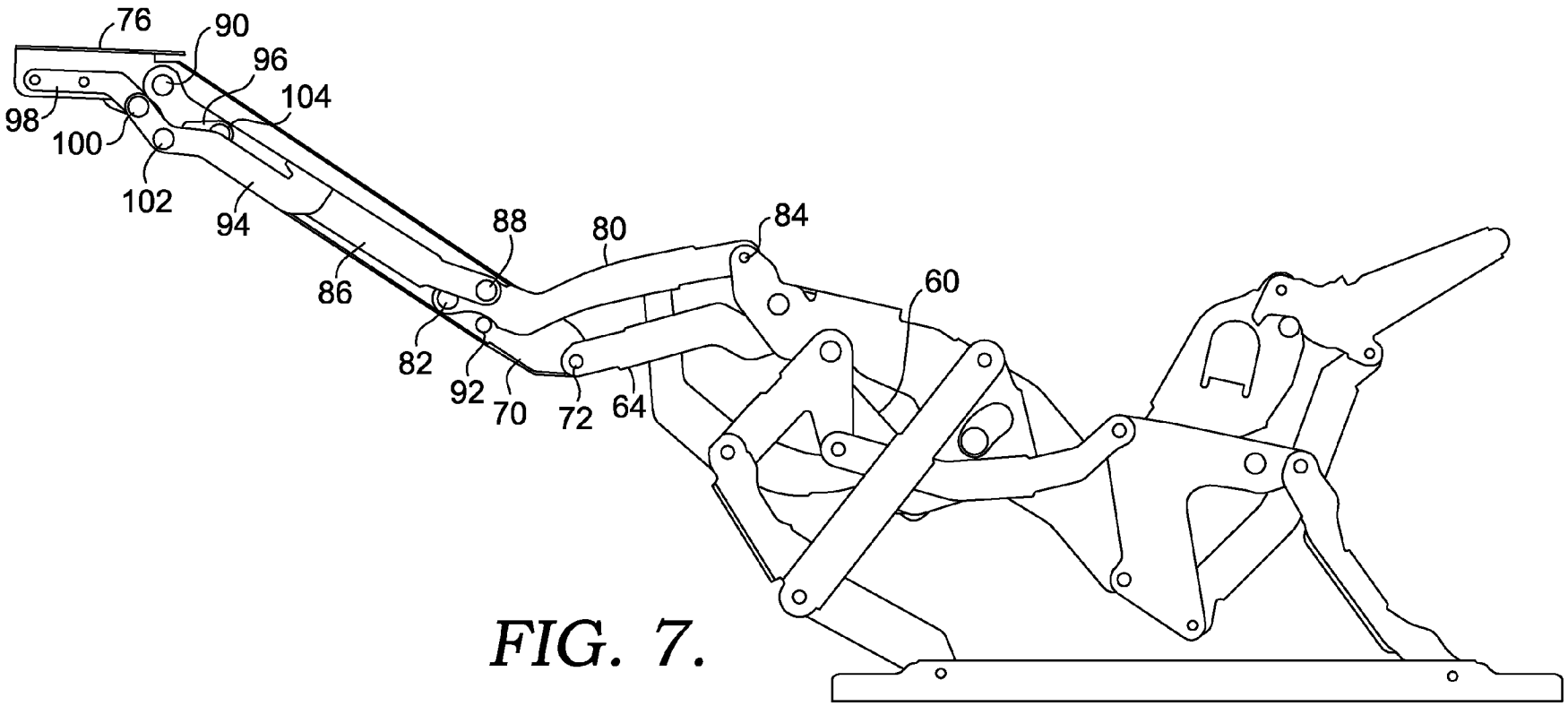
FIG. 7 is a side view of the linkage mechanism in the fully reclined position from a vantage point internal to the seating unit, in accordance with an embodiment of the present invention.
Figure 8:
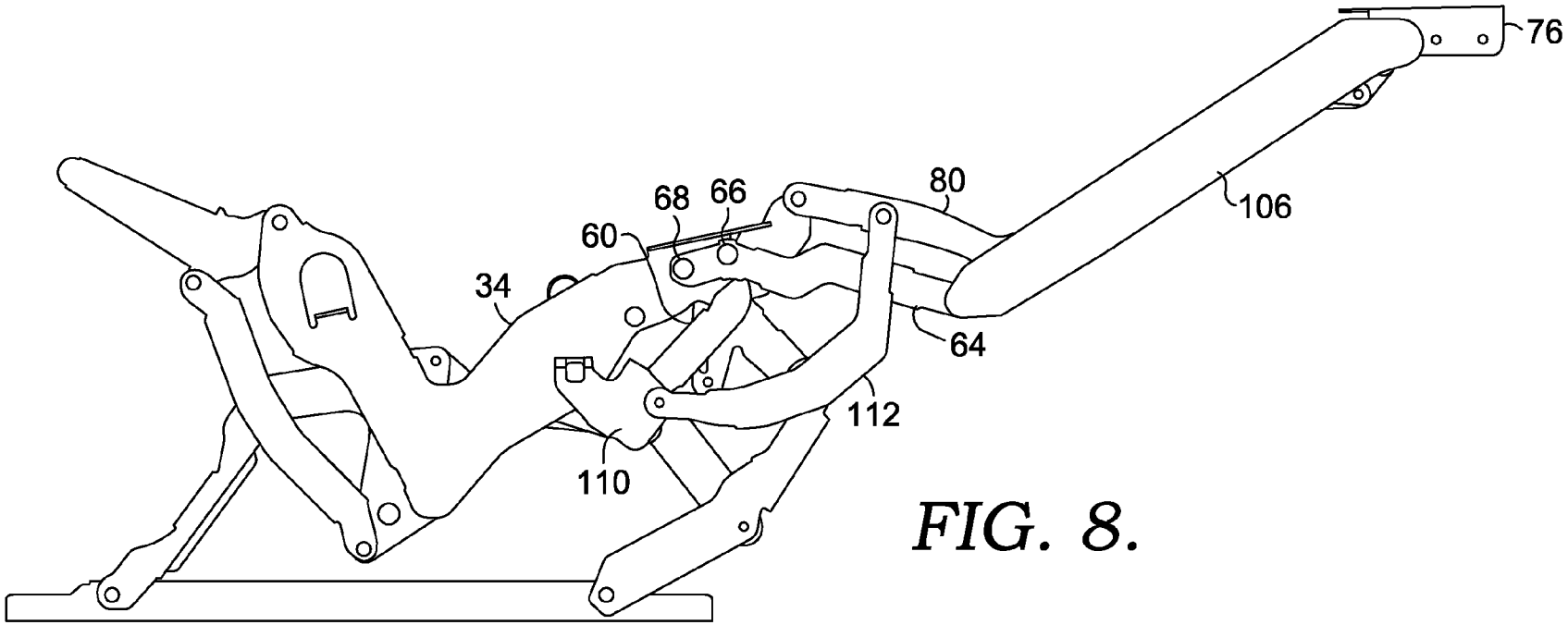
FIG. 8 is a view similar to FIG. 7, but from a vantage point external to the seating unit.

The mechanism 10 is moveable from the closed position shown in FIG. 1, to the extended position, or TV position, shown in FIG. 4, to the fully reclined position shown in FIG. 7. While the various links of the entire mechanism 10 are described below for completeness, the profile ottoman described could be used on a variety of mechanisms. It should also be understood and appreciated that the pivotable couplings (illustrated as pivot points in the figures) between the links can be in a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

Each side of mechanism 10 includes a side rail 12 that extends from the front of the seating unit to the back. The rail 12 is used to mount the mechanism 10 to the base of the seating unit and operate as the base of the mechanism 10. A rear pivot link 14 extends upwardly from the rail 12 and is pivotally connected to the rail 12 at a lower end thereof. Unless otherwise described differently, each of the rails, links, and brackets described herein are typically made of formed or stamped steel, but other materials with similar characteristics could be used. The upper end of rear pivot link 14 is pivotally coupled to a rear lift link 16 at pivot 18. Rear lift link 16 is also pivotally coupled to a rear control link 20 at pivot 22. Finally, rear lift link 16 is pivotally coupled to a bridge link 24 at pivot 26. As can be seen, rear lift link 16 is somewhat triangularly shaped and connects the rear pivot link 14, the rear control link 20, and the bridge link 24. As best seen in FIG. 1, rear lift link 16 has a stop pin 28 that contacts rear pivot link 14 when the mechanism is in a closed position.

As stated above, the rear control link 20 is coupled on one end to the rear lift link 16. It extends upwardly and rearwardly, and is pivotally connected to a back mounting link 30 at its other end, at pivot 32. Rear control link 20 is thus pivotally connected between rear lift link 16 and back mounting link 30. Back mounting link 30 has a forward end that is pivotally coupled to a seat mounting plate 34 at pivot 36. Near pivot 36, back mounting link 30 has a lower cam surface that contacts a stop pin 38 that is rigidly coupled to seat mounting plate 34. The upper end of back mounting link 30 is used to couple the backrest of the seating unit to the mechanism 10. As back mounting link 30 pivots rearwardly, the backrest is reclined.

Figure 3:
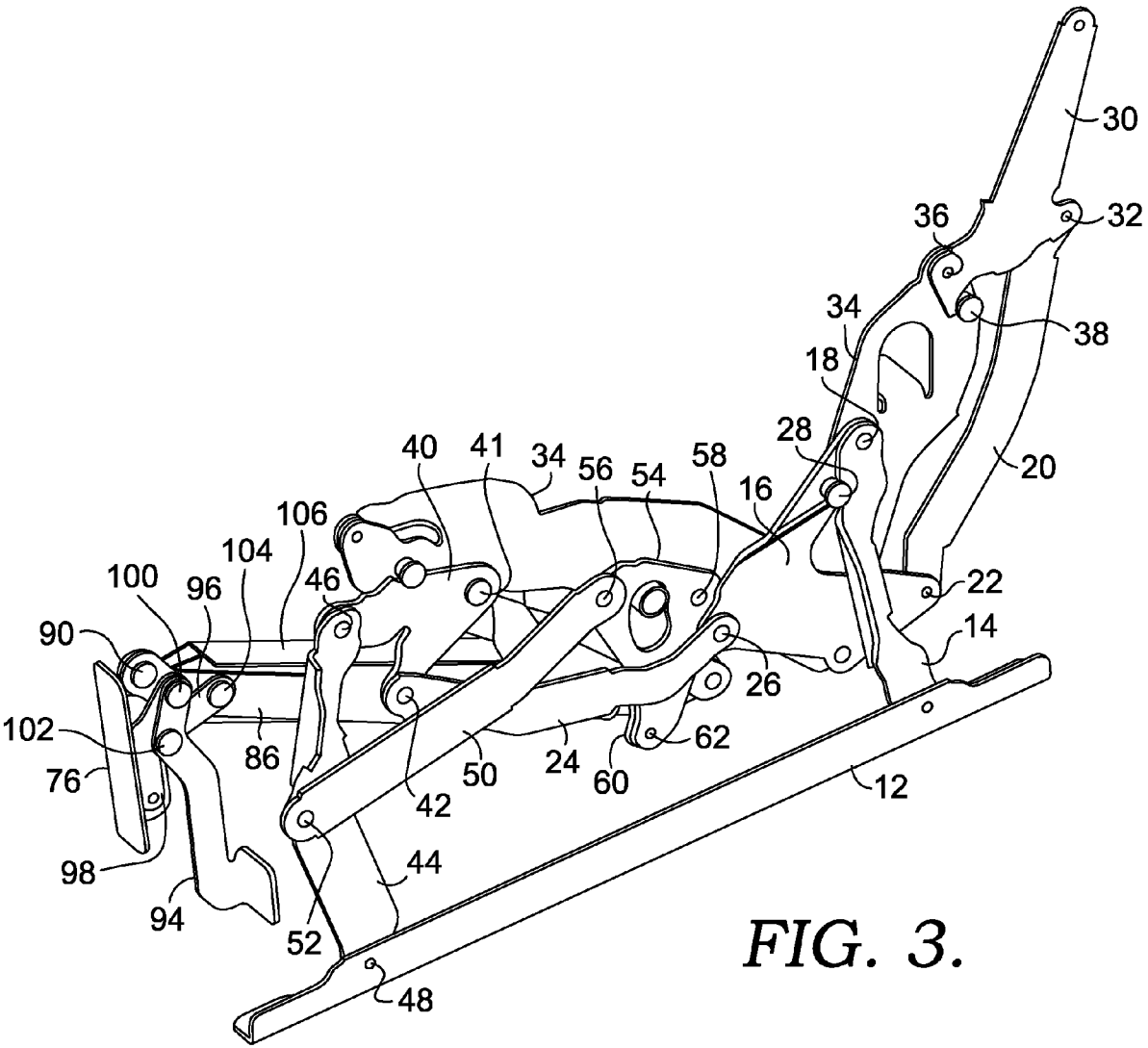
FIG. 3 is a perspective view of the mechanism in the closed position of FIG. 1.

Returning to bridge link 24, it can be seen that one end of bridge link 24 is pivotally coupled to rear lift link 16 at pivot 26. The opposite, forward end of bridge link 24 is pivotally coupled to a front lift link 40 at pivot 42. As best seen in FIG. 3, bridge link 24 has an outward bend section to provide clearance for other links of mechanism 10 to move properly and freely. The front lift link 40 is pivotally coupled to seat mounting plate 34 at pivot 41. The front lift link 40 is also pivotally coupled to a front pivot link 44 at pivot 46. Front lift link 40 is thus pivotally connected to bridge link 24, seat mounting plate 34, and front pivot link 44.

Front pivot link 44 is thus coupled on one end to the front lift link 40 and is pivotally coupled on the opposite, lower end to side rail 12 at pivot 48. A carrier link 50 is pivotally coupled to front pivot link 44 at pivot 52 generally midway between pivots 46 and 48. Carrier link 50 extends rearwardly from pivot 52 and is coupled on its other end to a bell crank 54 at pivot 56. As with bridge link 24, carrier link 50 has a bend section to provide clearance for the other links of mechanism 10.

Figure 2:
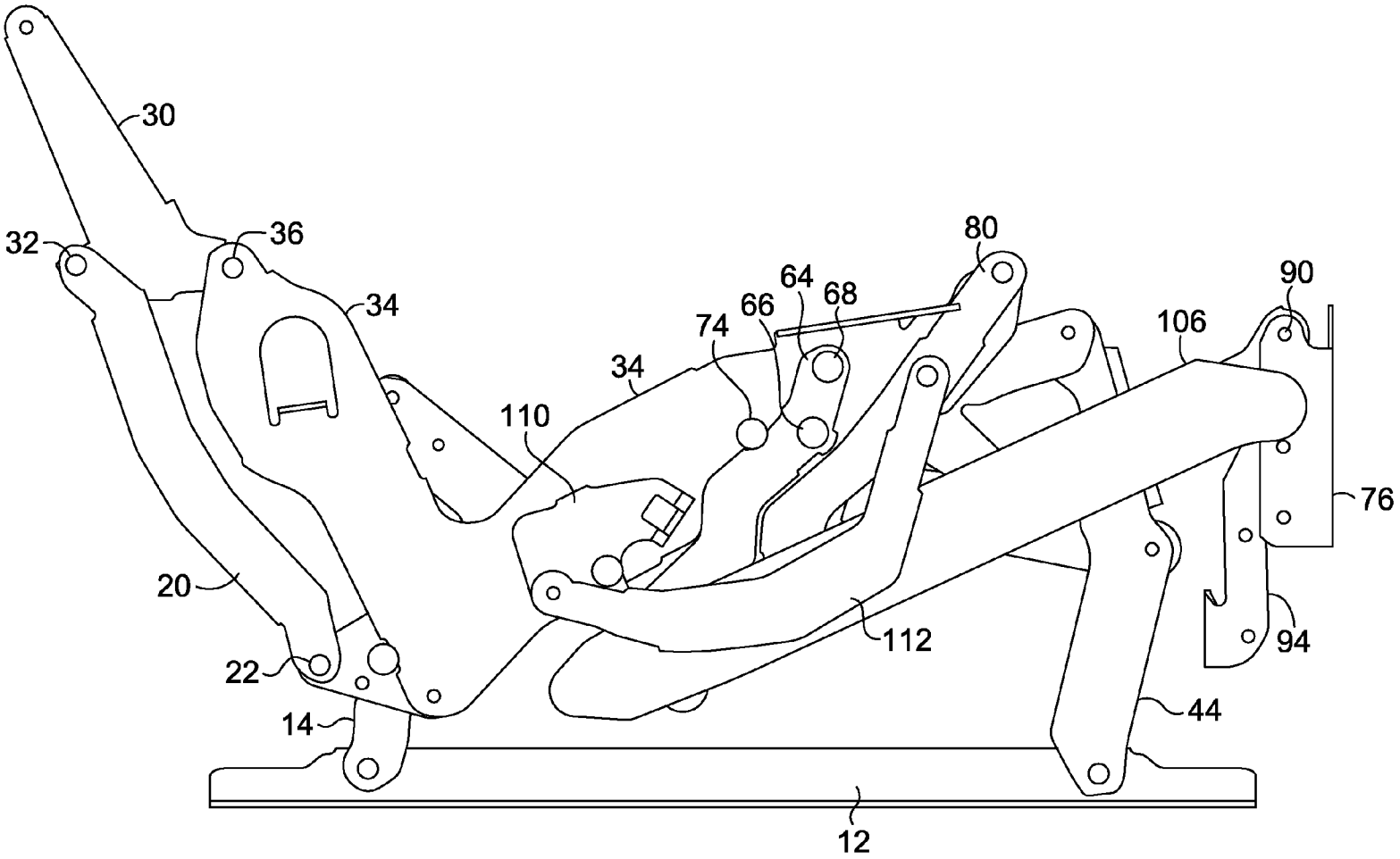
FIG. 2 is a view similar to FIG. 1, but from a vantage point external to the seating unit.
Figure 5:
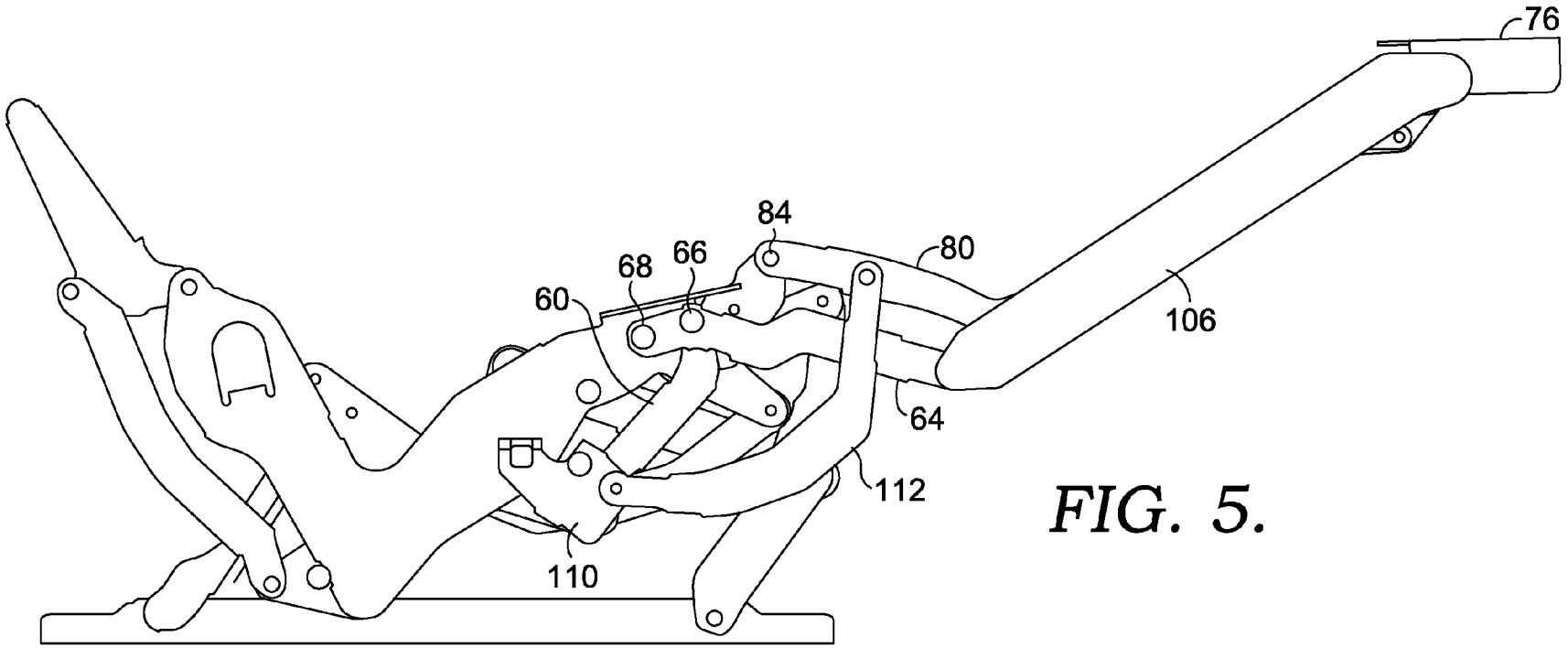
FIG. 5 is a view similar to FIG. 5, but from a vantage point external to the seating unit.
Figure 6:
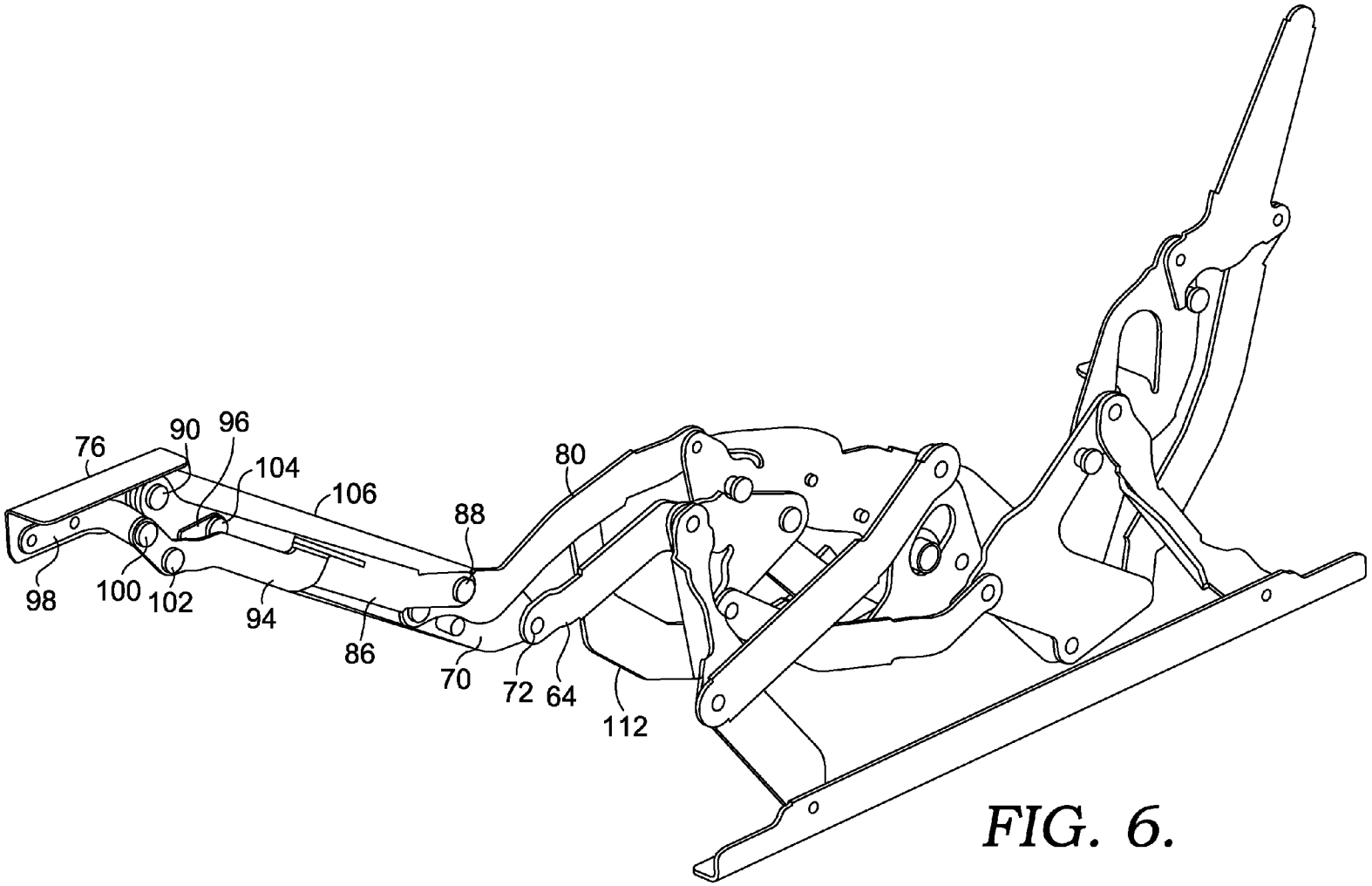
FIG. 6 is a perspective view of the mechanism in the extended TV position of FIG. 4.

Bell crank 54 has a somewhat triangular shape, as shown. As stated above, one end of bell crank 54 is pivotally coupled to carrier link 50 at pivot 56. Generally, at the midpoint, bell crank 54 is pivotally coupled to seat mounting plate 34 at pivot 58 (see FIG. 3). The lower, opposite end (as seen in FIG. 3) of bell crank 54 is pivotally coupled to ottoman drive link 60 at pivot 62. As best seen in FIG. 5, the end of ottoman drive link 60 opposite pivot 62 is pivotally coupled to rear ottoman link 64 at pivot 66. Rear ottoman link 64 is pivotally coupled at its top end to seat mounting plate 34 at pivot 68. As seen in FIG. 2, rear ottoman link 64 has a notch to accommodate a stop pin 74 on seat plate 34 when the linkage is in a closed position. The other end of rear ottoman link 64 is pivotally coupled to an outside ottoman link 70 at pivot 72 (as best seen in FIGS. 6 and 7). The outside ottoman link 70 is part of the profile ottoman linkage and is pivotally coupled at its opposite end to a footrest bracket 76 at a pivot (hidden from view). Footrest bracket 76 is connected to and supports the ottoman for the seating unit. The outside ottoman link 70 is also pivotally coupled to a front ottoman link 80 at pivot 82. One end of front ottoman link 80 is pivotally coupled to seat mounting plate 34 at pivot 84. The other end of front ottoman link 80 is pivotally coupled to outside ottoman link 70 at pivot 82. Near pivot 82, front ottoman link 80 is pivotally coupled to an inside ottoman link 86 at pivot 88. Opposite pivot 88, inside ottoman link 86 is pivotally coupled to footrest bracket 76 at pivot 90. As best seen in FIG. 7, outside ottoman link 70 has a stop pin 92 rigidly secured near pivot 82. Stop pin 92 stops the extension of the profile ottoman linkage and prevents overextension.

Figure 9:
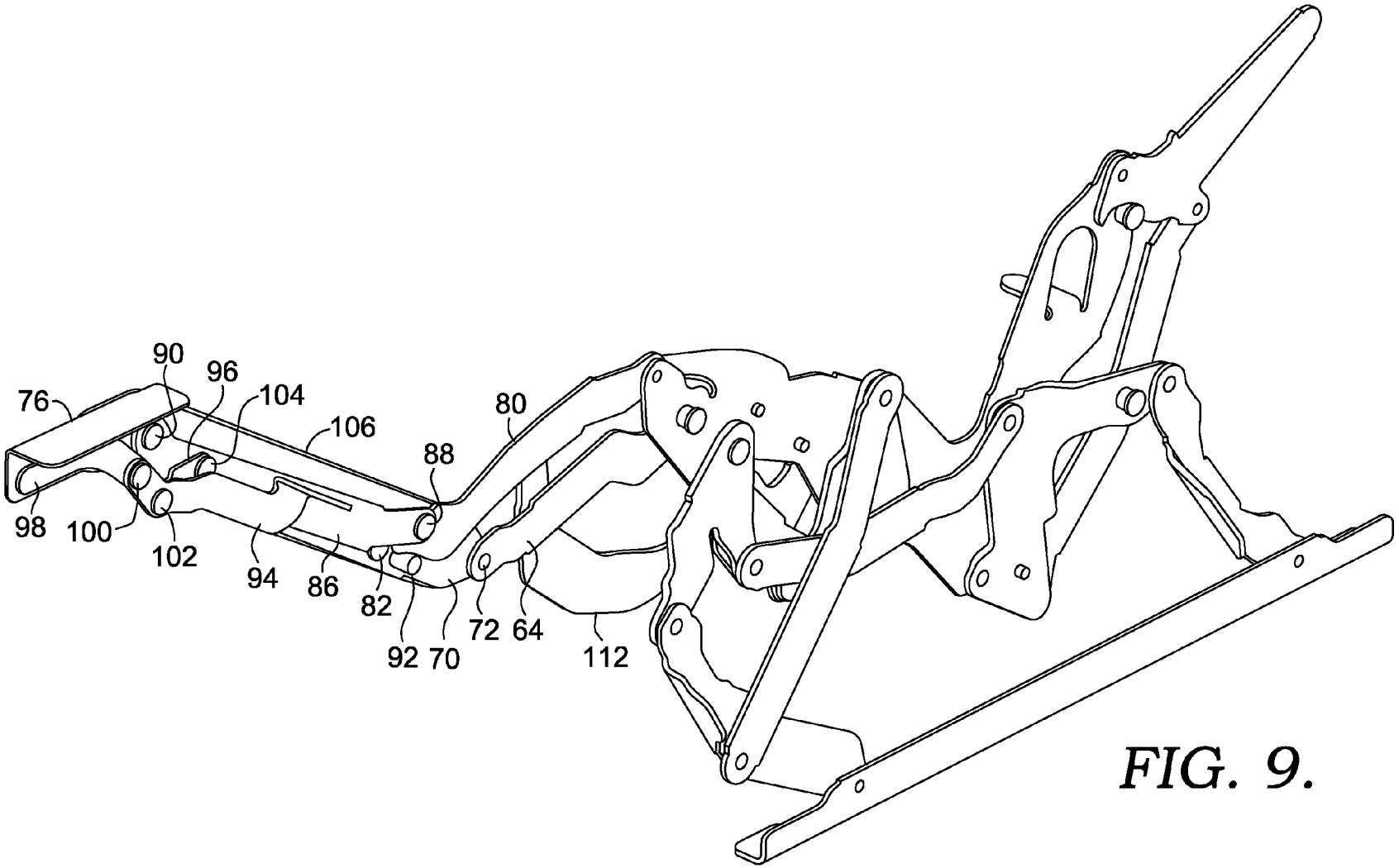
FIG. 9 is a perspective view of the mechanism in the fully reclined position of FIG. 7.
Figure 10:
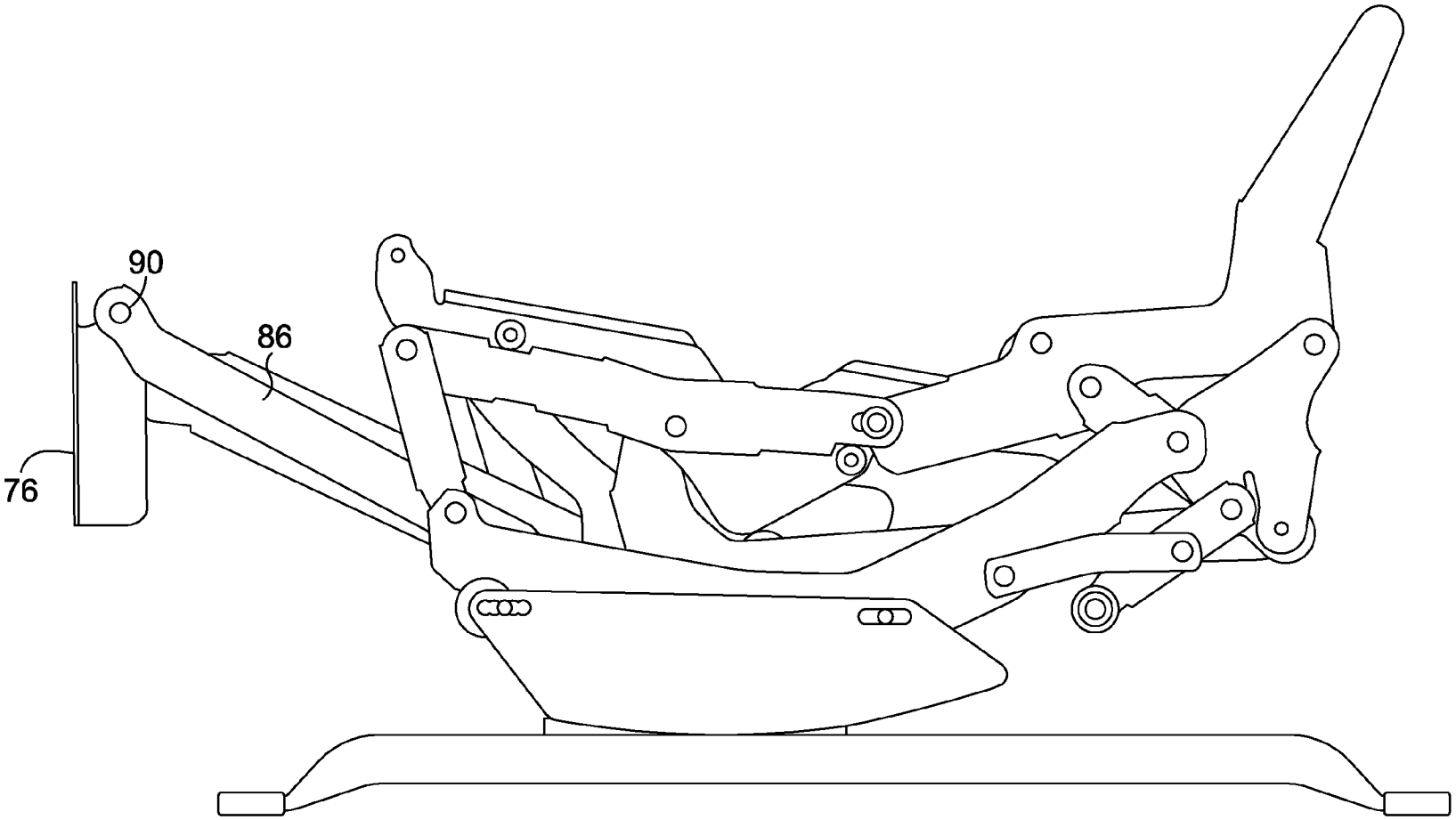
FIG. 10 is a side view of the linkage mechanism in the closed position from a vantage point internal to the seating unit, in accordance with an embodiment of the present invention.
Figure 11:
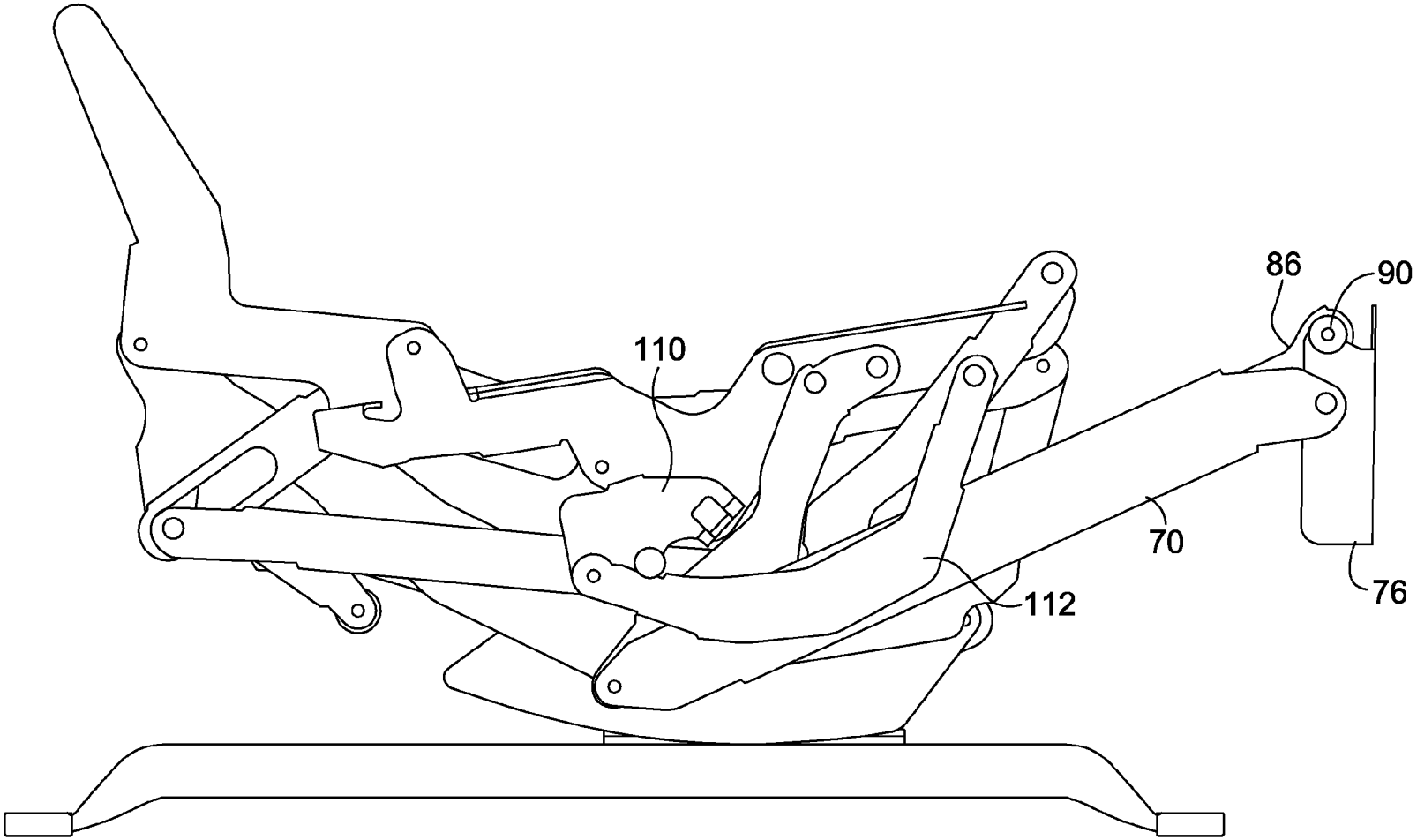
FIG. 11 is a view similar to FIG. 10, but from a vantage point external to the seating unit.
Figure 12:
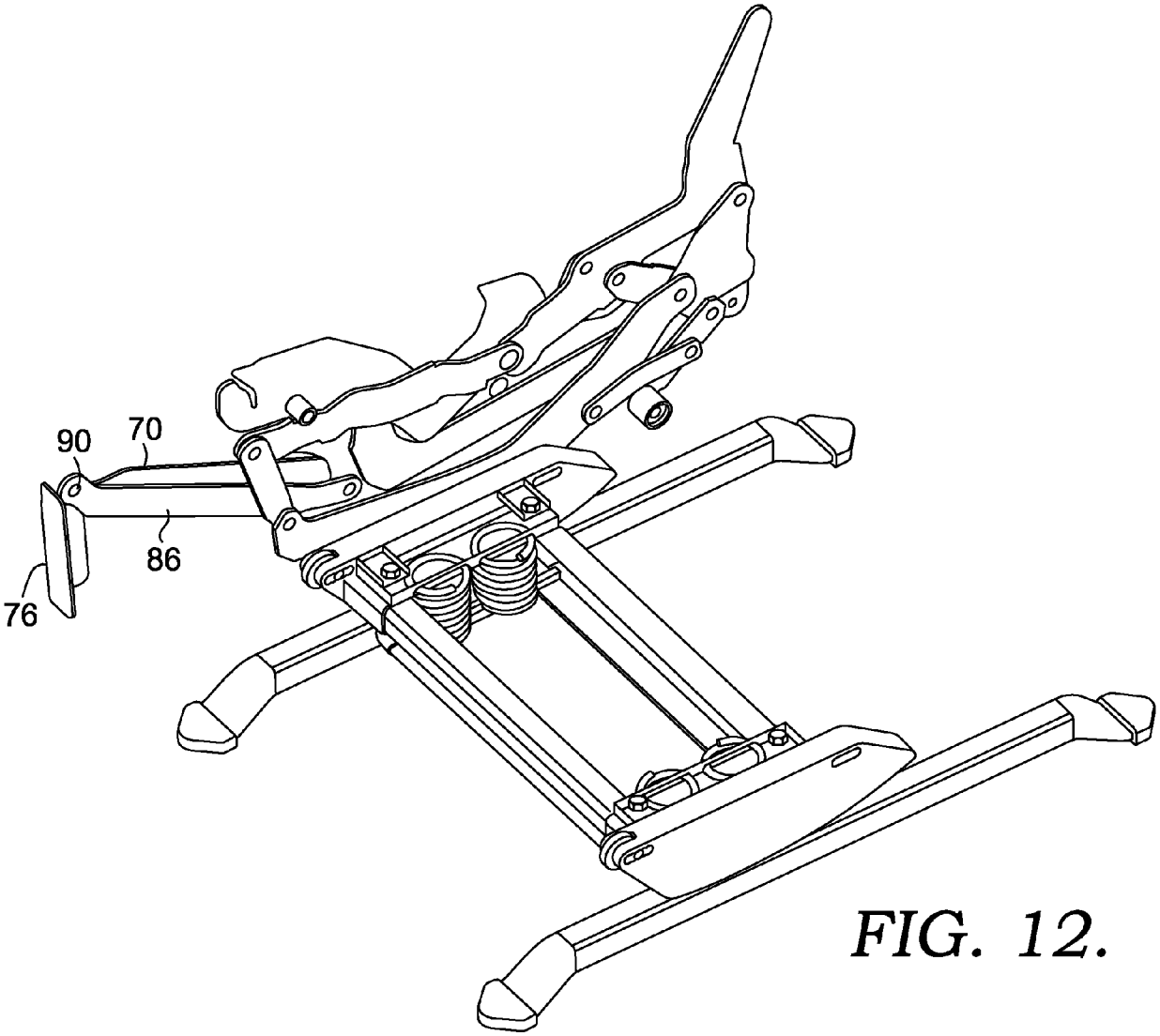
FIG. 12 is a perspective view of the mechanism in the closed position of FIG. 10.
Figure 13:
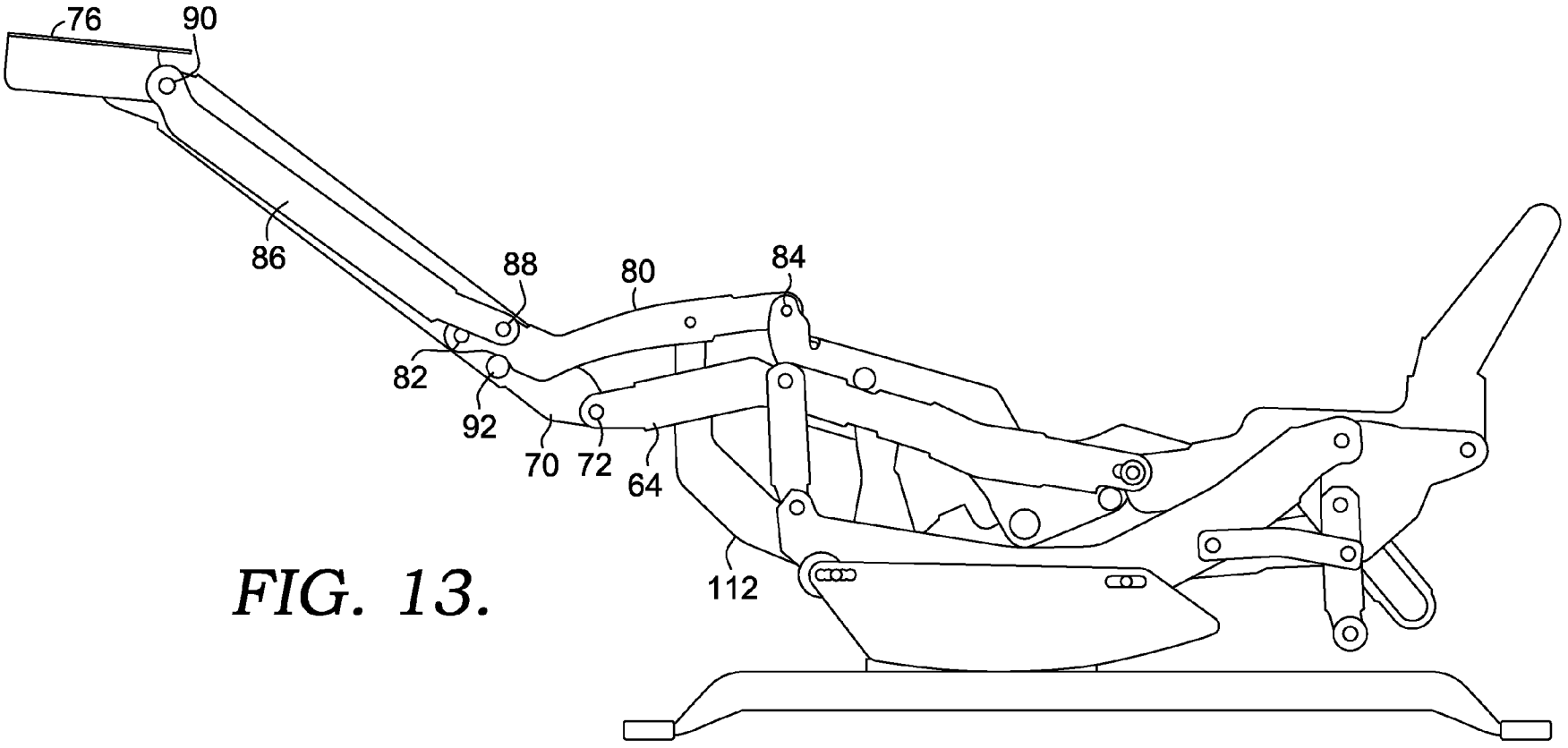
FIG. 13 is a side view of the linkage mechanism in the extended TV position from a vantage point internal to the seating unit, in accordance with an embodiment of the present invention.
Figure 14:
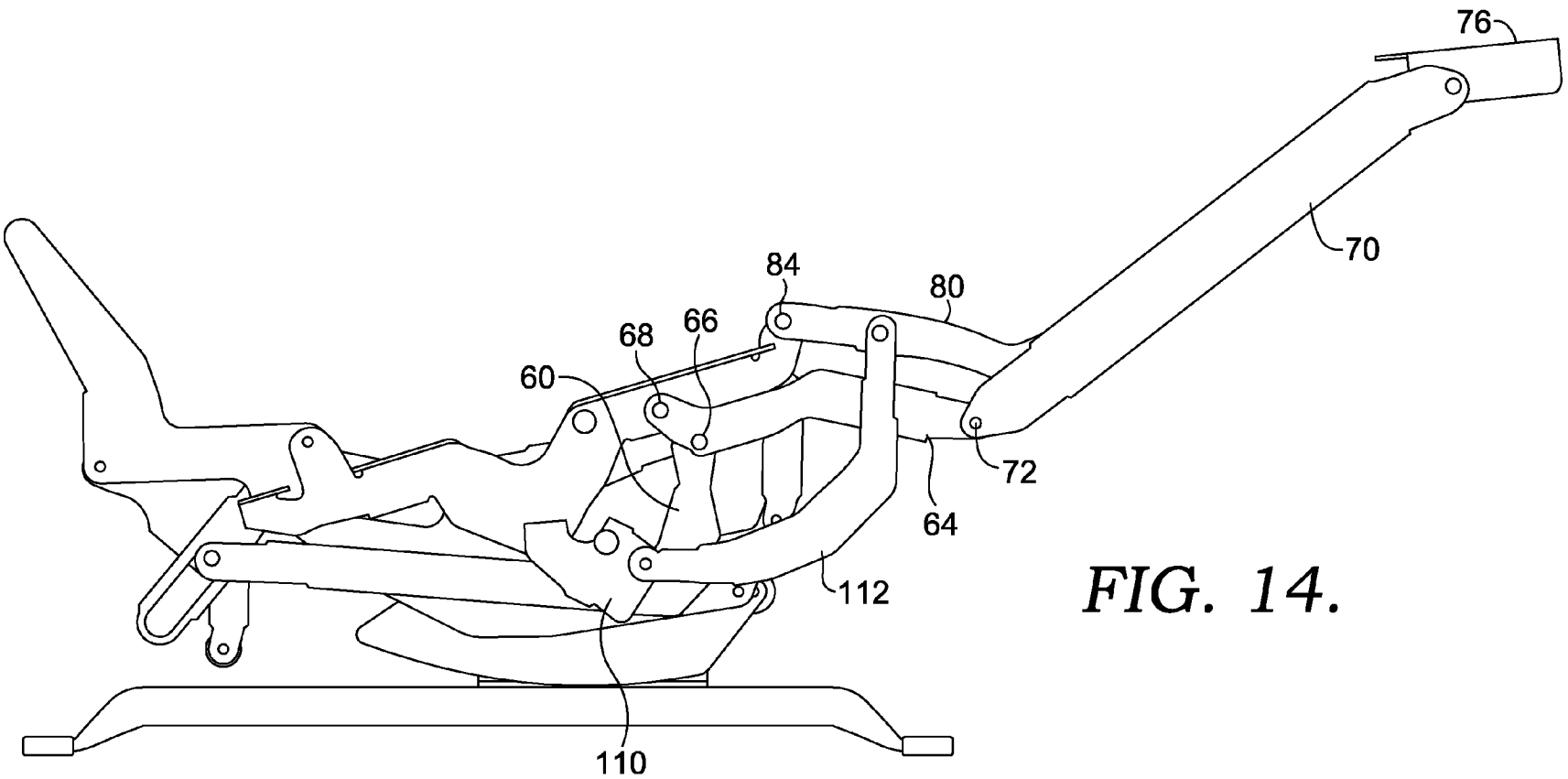
FIG. 14 is a view similar to FIG. 13, but from a vantage point external to the seating unit.
Figure 15:
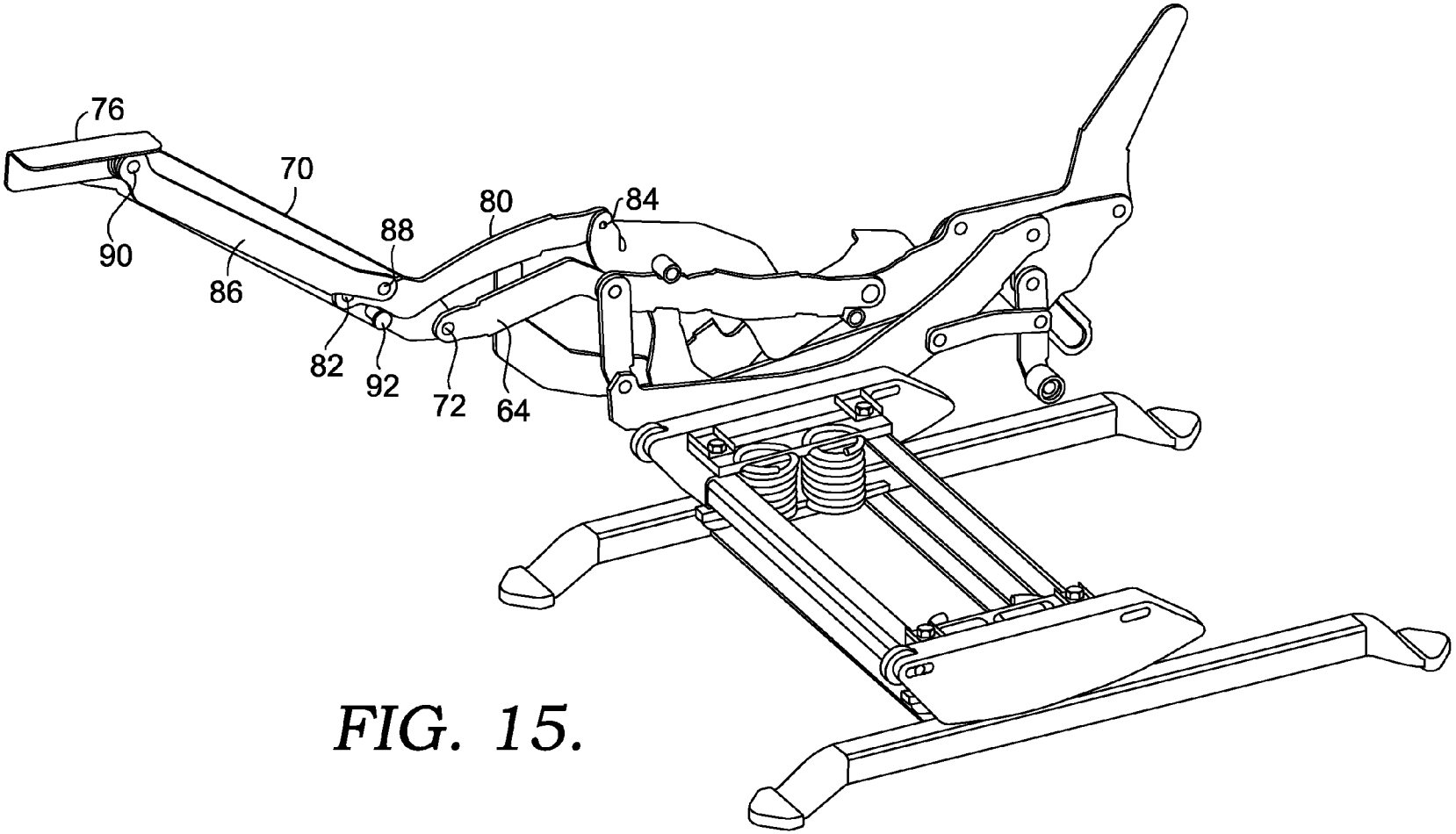
FIG. 15 is a perspective view of the mechanism in the extended TV position of FIG. 13.
Figure 16:
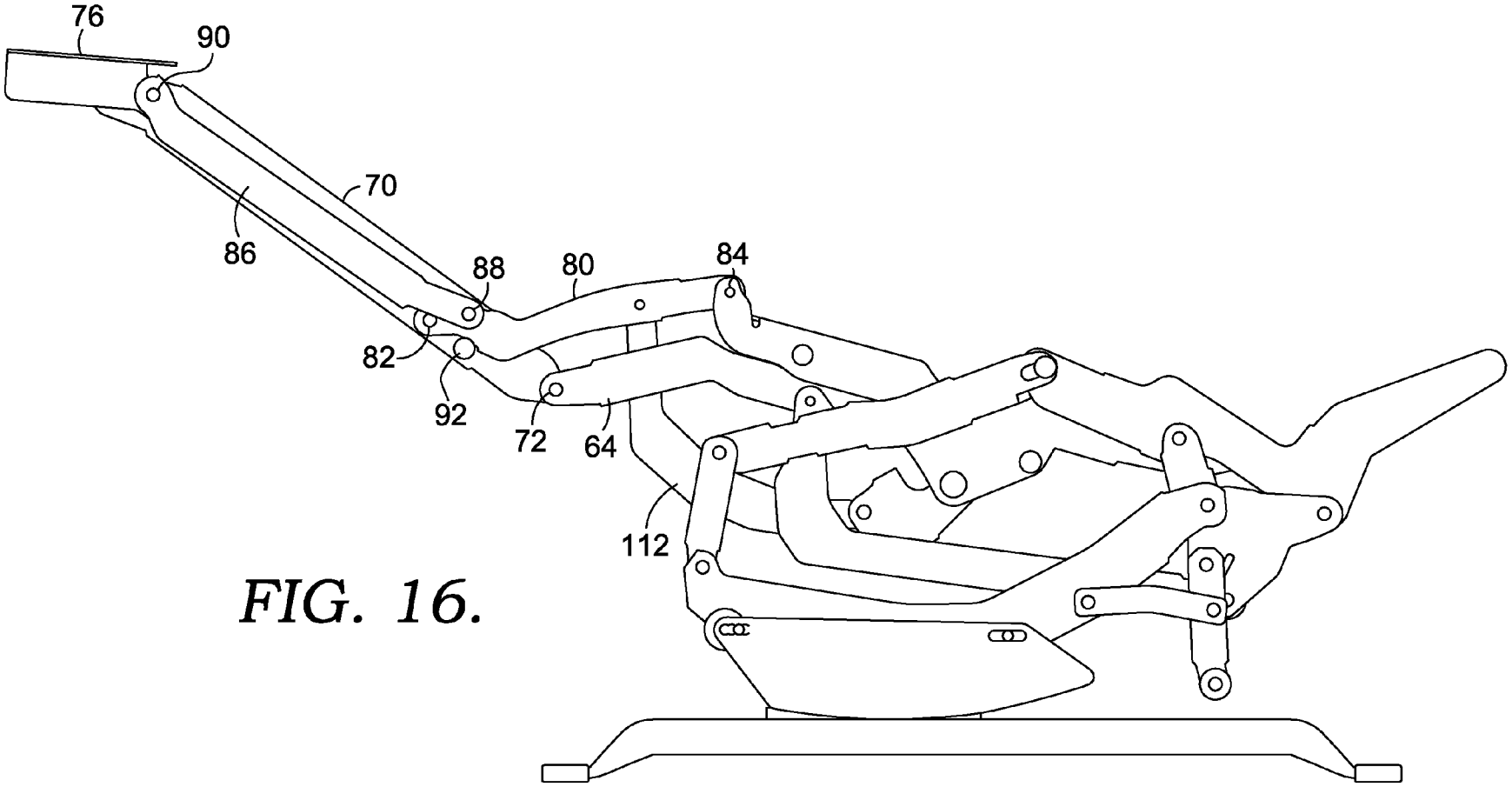
FIG. 16 is a side view of the linkage mechanism in the fully reclined position from a vantage point internal to the seating unit, in accordance with an embodiment of the present invention.
Figure 17:
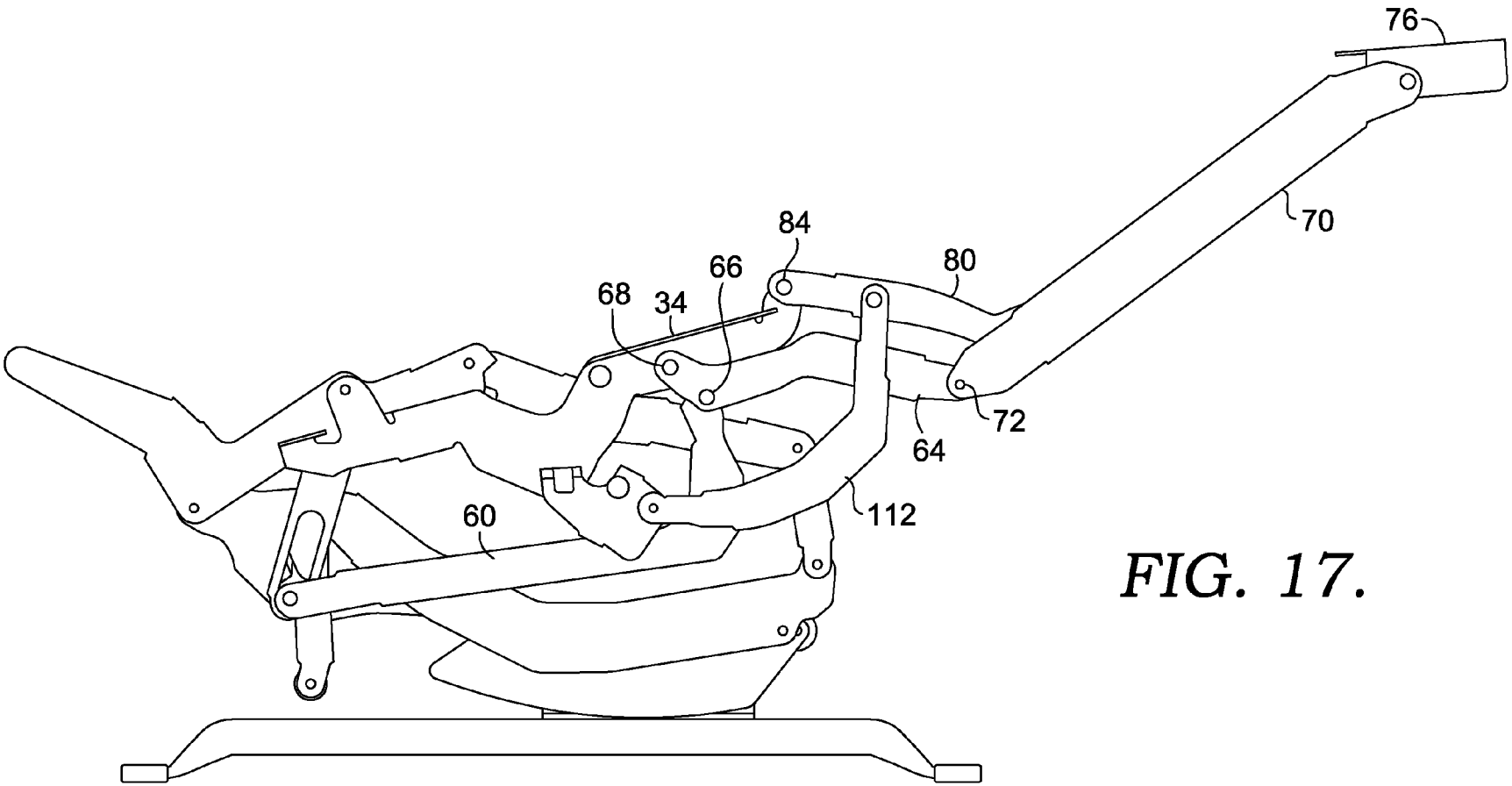
FIG. 17 is a view similar to FIG. 16, but from a vantage point external to the seating unit.
Figure 18:
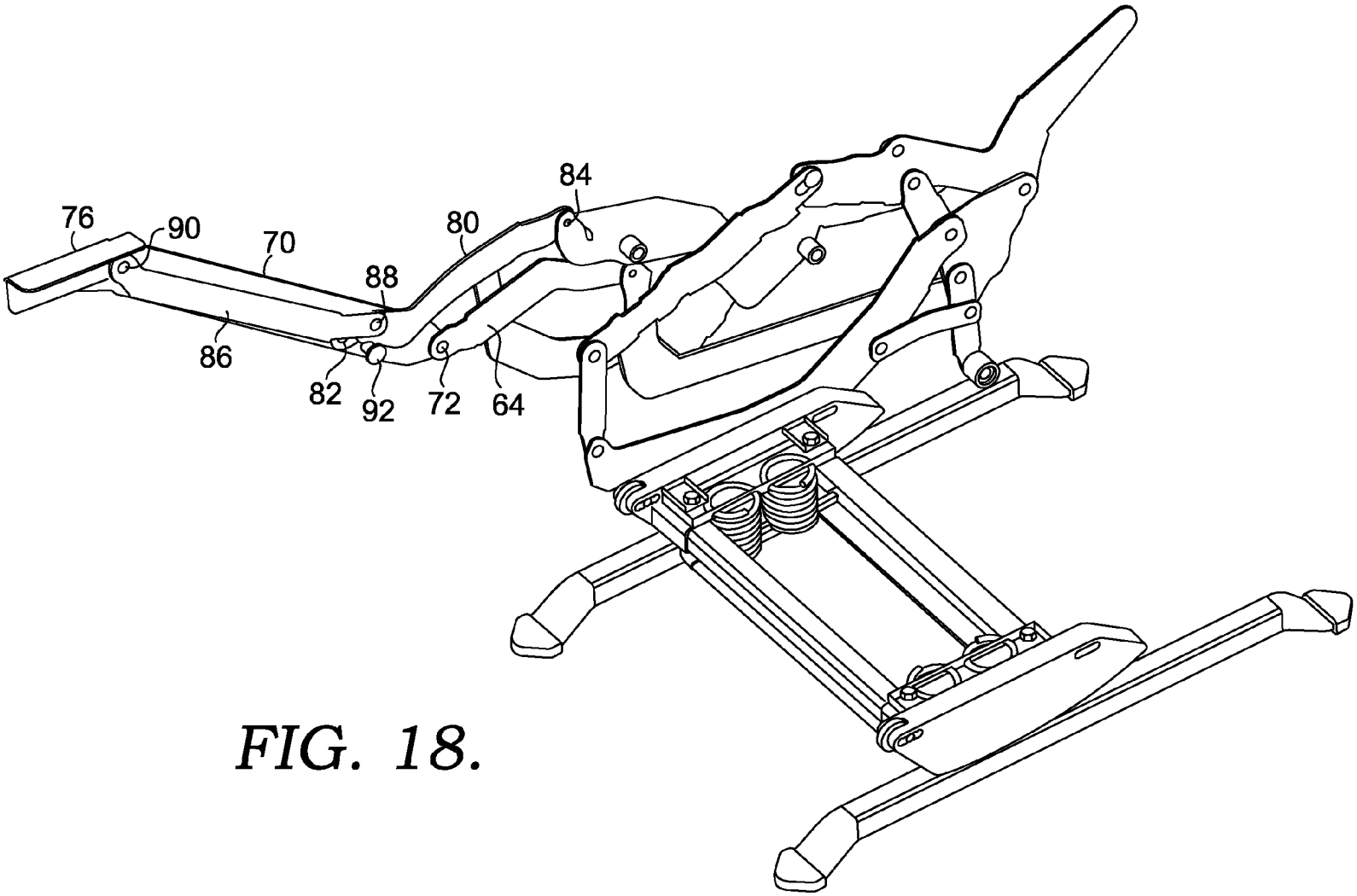
FIG. 18 is a perspective view of the mechanism in the fully reclined position of FIG. 16.
Figure 20:
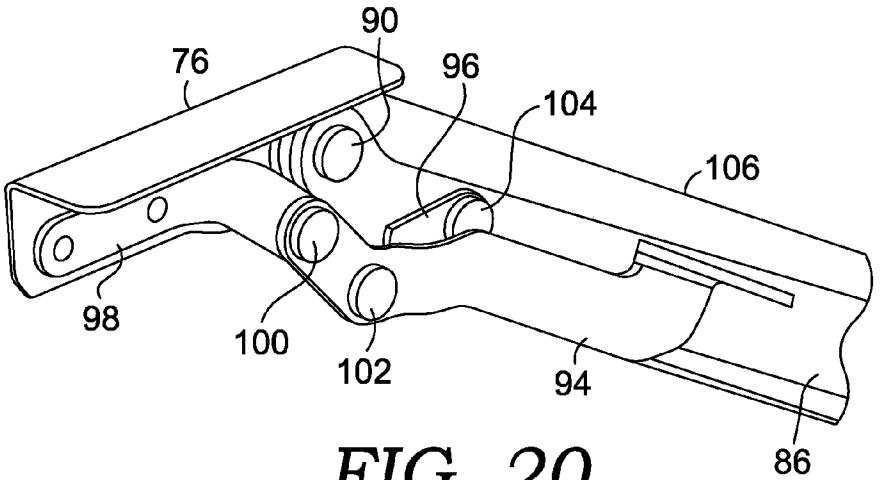
FIG. 20 is an enlarged, partial, perspective view similar to FIG. 19, but showing the mechanism in the extended position.
Figure 19:
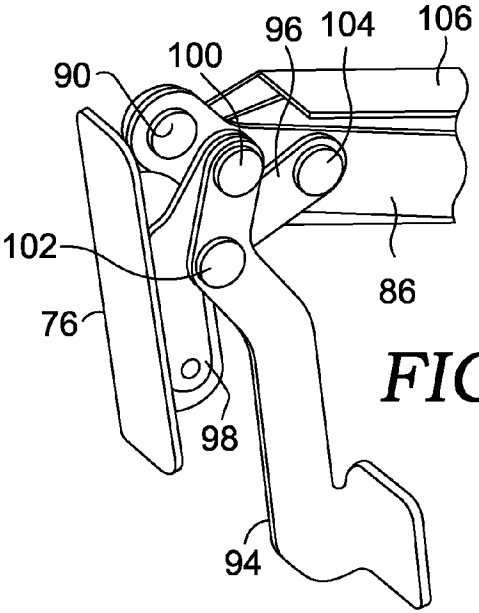
FIG. 19 is an enlarged, partial, perspective view of the front portion of the mechanism in the closed position.

As best seen in FIGS. 3, 6, and 9, the profile ottoman may include a mid-ottoman bracket 94. Mid-ottoman bracket 94 is pivotally coupled to inside ottoman link 86 via a control link 96. Additionally, mid-ottoman bracket 94 is pivotally coupled to the footrest bracket 76 via a mounting bracket 98 at pivot 100. The control link 96 is pivotally coupled on one end to mid-ottoman bracket 94 at pivot 102, and pivotally coupled on the other end to inside ottoman link 86 at pivot 104. These connections result in the mid-ottoman rotating counter-clockwise (viewed from FIG. 1) in a "reverse-flipper" type manner that is generally opposite to that of other known mid-ottomans. Additionally, the orientation and connection of mid-ottoman bracket 94 results in the mid-ottoman bracket 94 being generally in-line with the outside ottoman link 70 when the mechanism is in the TV or fully reclined positions (as seen, for example, in FIGS. 4 and 7). Moreover, the connections and orientation of the front ottoman link 80, rear ottoman link 64, outside ottoman link 70, and inside ottoman link 86 cooperate to present a profile ottoman that has a sleek appearance, where the inside ottoman link 86 is generally in-line with the outside ottoman link 70 when in the TV or fully reclined positions. The result is not only an enhanced appearance, but also results in fewer pinch points as compared to other known ottoman linkages.

While the mid-ottoman bracket 94 is optional, if provided, it is also generally in-line with the outside ottoman link 70. As best seen in FIGS. 5-9, a shield 106 may be installed over the outside of outside ottoman link 70. Shield 106 may also have a top portion extending inwardly over the profile ottoman to generally cover the links of the profile ottoman. Shield 106 therefore not only enhances the appearance of the chair on which mechanism 10 is installed, but also provides additional protection from pinch points.

Returning to seat mounting plate 34, a drive bushing 108 (as seen in FIGS. 3 and 4) is secured through a clearance hole in seat mounting plate 34. Bushing 108 is used to support a drive tube (not shown) that operates to unlock the mechanism 10. The drive tube is coupled to a lock bracket 110 (seen in FIG. 2) that is also pivotally coupled to a lock link 112. The opposite end of lock link 112 is coupled to front ottoman link 80.

In operation, some mechanism (either manual or powered) is used to rotate the drive tube, which in turn rotates lock bracket 110. As lock bracket 110 and lock link 112 move, the mechanism moves from the over-center, closed condition to the TV or extended position, using gravity, power, or springs to assist. This drives the ottoman drive link 60 to rotate the rear ottoman link 64 and move the profile ottoman linkage to the extended position shown in FIGS. 4-6. The other links cooperate to move the remainder of the mechanism from the closed position of FIGS. 1-3 to the TV position of FIGS. 4-6. The mechanism may be moved from this position to the fully reclined position of FIGS. 7-9 by further rotating the back mounting link 30.

FIGS. 10-18 illustrate the profile ottoman incorporated onto a rocker mechanism, for use on a rocker-recliner. Many of the components of the rocker mechanism shown are known to those of skill in the art, and so are not further described here. The profile ottoman components are labeled to correspond with the links and pivots described above with respect to FIGS. 1-9. Only small changes need to be made to adapt the profile ottoman to the rocker-recliner. The rear ottoman link 64 is shown with a slightly different configuration. In addition, the ottoman drive link 60 has a different design as well. The profile ottoman is shown in FIGS. 10-18 without the optional shield (106 in FIGS. 1-9) and without the mid-ottoman (94, 96, and 98 in FIGS. 1-9).

To summarize, the profile ottoman described above provides an ottoman that has a sleek appearance, where the inside ottoman link 86 is generally in-line with the outside ottoman link 70 when in the TV or fully reclined positions. The outside ottoman link 70 thus effectively hides from view most of the ottoman components. The result is not only an enhanced appearance, but fewer pinch points as compared to other known ottoman linkages. While the mid-ottoman bracket 94 is optional, if provided, it also is generally in-line with the outside ottoman link 70, and thus largely hidden from view in the TV or fully reclined positions. Finally, a shield 106 may be installed to further cover the links of the profile ottoman. Shield 106 therefore not only further enhances the appearance, but also provides additional protection from pinch points.

While the profile ottoman has been described above on a zero-wall mechanism, and a rocker-recliner mechanism, it is easily adaptable to be installed on other mechanisms with only slight modifications needed.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An ottoman linkage that moves a footrest from a closed position to an extended position, the linkage comprising:

a front ottoman link having a first end adapted to be coupled to a seat mounting plate;

an outside ottoman link pivotally coupled to a second end of the front ottoman link opposite the first end;

a rear ottoman link adapted to be coupled on one end to the seat mounting plate, and on the other end to the outside ottoman link; and an inside ottoman link pivotally coupled on a first end to the front ottoman link, and pivotally coupled on a second end to a footrest bracket, the inside ottoman link being generally in-line with the outside ottoman link when the mechanism is in an extended position, and the outside ottoman link having a width that obscures the inside ottoman link from view;

a control link pivotally coupled on a first end at a point located between the first and second end of the inside ottoman link; and a mid-ottoman bracket pivotally coupled at a first point at the second end of the inside ottoman link, the mid-ottoman bracket also being pivotally coupled at a second point at the second end of the control link;

the control link also being pivotally coupled on a second end at a point located between a first and second end of the mid-ottoman bracket.

2. The ottoman linkage of claim 1, wherein the mid-ottoman bracket rotates counter-clockwise when the ottoman linkage is adjusted from a closed position to an extended position.

3. The ottoman linkage of claim 1, further comprising a shield which is substantially in-line with the outside ottoman link, and wherein the shield is coupled at a first end to the footrest bracket, and coupled at a second end to the rear ottoman link.

4. The ottoman linkage of claim 3, wherein the shield has a top portion sized to cover the inside ottoman link, outside ottoman link, and control link.

5. A linkage mechanism configured to adjust a reclining seating unit between a reclined, an extended, and a closed position, the linkage mechanism comprising:

a base rail;

a seat mounting plate for supporting a seat of the seating unit; and a footrest assembly for adjusting one or more foot-support ottomans between the closed and extended positions, wherein the footrest assembly is pivotally coupled to the seat mounting plate, the footrest assembly further comprising:

(a) a front ottoman link having a first end adapted to be coupled to a seat mounting plate;

(b) an outside ottoman link pivotally coupled to a second end of the front ottoman link opposite the first end;

(c) a rear ottoman link adapted to be coupled on one end to the seat mounting plate, and on the other end to the outside ottoman link;

(d) an inside ottoman link pivotally coupled on a first end to the front ottoman link, and pivotally coupled on a second end to a footrest bracket, the footrest bracket also being pivotally coupled, opposite the coupling to the front ottoman link, to the footrest bracket, the inside ottoman link being generally in-line with the outside ottoman link when the mechanism is in an extended position, and the outside ottoman link having a width that obscures the inside ottoman link from view;

(e) a mid-ottoman bracket pivotally coupled at a first point at the second end of the inside ottoman link, the mid-ottoman bracket also being pivotally coupled at a second point at the second end of the control link, wherein the mid-ottoman bracket rotates counter-clockwise when the footrest assembly is adjusted from a closed position to an extended position; and (f) a control link pivotally coupled on a first end at a point located between the first and second end of the inside ottoman link, the control link also being pivotally coupled on a second end at a point located between a first and second end of the mid-ottoman bracket.

6. A seating unit, comprising:

a pair of base rails in substantially parallel-spaced relation;

a pair of seat mounting plates in substantially parallel-spaced relation; and a pair of generally mirror-image linkage mechanisms each moveably interconnecting the seat mounting plates to the base rails, respectively, and adapted to move the seating unit between a closed position, an extended position, and a reclined position, wherein each of the linkage mechanisms has an ottoman linkage that comprises:

a front ottoman link having a first end adapted to be coupled to the seat mounting plate;

an outside ottoman link pivotally coupled to a second end of the front ottoman link opposite the first end;

a rear ottoman link adapted to be coupled on one end to the seat mounting plate, and on the other end to the outside ottoman link; and an inside ottoman link pivotally coupled on a first end to the front ottoman link, and pivotally coupled on a second end to a footrest bracket, the inside ottoman link being generally in-line with the outside ottoman link when the mechanism is in an extended position, and the outside ottoman link having a width that obscures the inside ottoman link from view; and a control link pivotally coupled on a first end at a point located between the first and second end of the inside ottoman link; and a mid-ottoman bracket pivotally coupled at a first point at the second end of the inside ottoman link, the mid-ottoman bracket also being pivotally coupled at a second point at the second end of the control link;

the control link also being pivotally coupled on a second end at a point located between a first and second end of the mid-ottoman bracket.

7. The ottoman linkage of claim 6, wherein the mid-ottoman bracket rotates counter-clockwise when the ottoman linkage is adjusted from a closed position to an extended position.

8. The ottoman linkage of claim 7, further comprising a shield which is substantially in-line with the outside ottoman link, and wherein the shield is coupled at a first end to the footrest bracket, and coupled at a second end to the rear ottoman link.

9. The ottoman linkage of claim 8, wherein the shield has a top portion sized to cover the inside ottoman link, outside ottoman link, and control link.

* * * * *